US006588651B2

(12) United States Patent
Quaintance

(10) Patent No.: US 6,588,651 B2
(45) Date of Patent: Jul. 8, 2003

(54) OCTAGONAL BULK BIN

(75) Inventor: Benjamin William Quaintance, Germantown, TN (US)

(73) Assignee: International Paper Company, Tuxedo, NY (US)

( * ) Notice: Subject to any disclaimer, the term of this patent is extended or adjusted under 35 U.S.C. 154(b) by 0 days.

(21) Appl. No.: 09/767,074

(22) Filed: Jan. 22, 2001

(65) Prior Publication Data

US 2002/0096559 A1 Jul. 25, 2002

(51) Int. Cl.[7] ..... B65D 5/10
(52) U.S. Cl. ..... 229/109; 229/110; 229/920
(58) Field of Search ..... 229/109, 110, 229/199, 920

(56) References Cited

U.S. PATENT DOCUMENTS 2,340,473 A * 2/1944 Johnson ..... 229/199
3,232,516 A * 2/1966 Arslanian ..... 229/920
3,957,179 A * 5/1976 Bamburg et al. ..... 229/109
4,392,607 A * 7/1983 Perkins, Jr. ..... 229/109
4,702,408 A * 10/1987 Powlenko ..... 229/920
4,850,506 A * 7/1989 Heaps, Jr. et al. ..... 229/109
5,178,275 A * 1/1993 Fitzgerald et al. ..... 229/109
5,738,272 A * 4/1998 Anchor et al. ..... 229/109

FOREIGN PATENT DOCUMENTS

GB 2243596 A * 11/1991 ..... 229/109

* cited by examiner

*Primary Examiner*—Gary E. Elkins
(74) *Attorney, Agent, or Firm*—Dennis H. Lambert

(57) ABSTRACT

An octagonal bulk bin of corrugated paperboard has opposed parallel side walls spaced a predetermined distance apart and opposed parallel end walls spaced a predetermined distance apart. The side and end walls are joined by diagonal corner panels. The diagonal corner panels are made wider than the corner panels in a conventional bin, and the side and end walls are narrower, with the corner panels and the end walls having approximately the same width, while maintaining the predetermined spacing. This configuration reduces the bulge experienced when product is loaded into the bin. In addition to the wider corner panels, or in lieu thereof, scores may be placed in at least one of the side and end panels to define a line along which controlled and predetermined buckling will take place, if buckling occurs.

9 Claims, 4 Drawing Sheets

OCTAGONAL BULK BIN

BACKGROUND OF THE INVENTION

1. Field of the Invention

This invention relates generally to shipping and storage containers. More specifically, the invention relates to corrugated paperboard bulk bins configured to reduce sidewall bulge.

2. Prior Art

In the bulk handling of materials, e.g., processed poultry products, tomato paste, meat, fresh produce, etc., containers of relatively large size are commonly used to transport and store the material. These containers must be capable of withstanding the weight of the contents, which can exceed two thousand pounds, as well as the rough handling to which they may be subjected. Further, they should be capable of being handled with mechanized equipment, which typically requires the container to be placed on a pallet. In the handling of certain poultry products, the pallet has dimensions of 48×40 inches, and the containers are sized to closely fit on the pallet.

A bulk bin commonly used for flowable products, e.g., ground-up poultry products, has a generally rectangular transverse cross-section, with the four corners mitered to produce an octagonal shape. This shape fits the 48×40 inch pallet typically used in the food industry. However, the resulting container has four relatively wide side walls or panels joined by four narrow diagonal panels. When a flowable product is loaded into the bin, the wide panels tend to buckle or bulge outwardly in the middle. The added package width caused by this buckling or bulging creates significant pallet overhang and an interference fit in warehouse storage racks and transportation trailers.

Accordingly, there is a need for a corrugated paperboard bulk bin which is configured to have reduced sidewall bulge when loaded with product, and which fits a standard 48×40 inch pallet.

SUMMARY OF THE INVENTION

The present invention comprises a bulk bin which is strong and durable, and which is configured to have less sidewall bulge than conventional bins when loaded with product.

In particular, the bin of the invention is made of corrugated paperboard and has an octagonal shape with opposed pairs of parallel side and end walls and diagonal corner panels. The diagonal corner panels are increased in width relative to conventional octagonal bins, whereby the diagonal corner panels have the same width as the end walls, thus reducing the width of the end walls as well as the width of the side walls. This relationship more evenly distributes the load, and reduces scoreline pressure, resulting in fewer failures and reduced sidewall bulge when the bin is loaded with product, especially flowable product. This eliminates problems of overhang and interference in warehouse storage racks and transportation trailers.

The bin of the invention has adequate strength to withstand the weight of the contents, and is configured so that it is capable of being palletized on conventional pallets so that it can be efficiently handled with mechanized equipment. The bin can be collapsed for compact storage, and has a locking bottom flap construction that is quick and easy to set up and is durable even when subjected to rough handling. A flexible liner or bag is generally placed in the bin when flowable materials are to be loaded into it.

In a specific example of an octagonal bulk bin incorporating the foregoing inventive feature, the width of the diagonal corner panels is increased by approximately 25%, or from 12¼ inches to 15½ inches, and the width of the end walls is reduced by approximately 25%, or from 20⅜ inches to 15½ inches, and the width of the side walls is reduced by approximately 20%, or from 28⅜ inches to 23½ inches. Stated differently, the bin of the invention is a slightly elongated equilateral octagon, with two of its opposed walls approximately 50% wider than the remaining walls. The distance or spacing between the opposed end walls and between the opposed side walls preferably remains the same as in a conventional octagonal bulk bin, whereby the bin of the invention will fit the pallets that are conventionally used. To maintain the volume the same as a conventional bin, the height of the bin of the invention may be increased by about 5%.

Further, strategically located crease lines may be placed in the sidewalls to cause buckling to occur in predetermined positions and patterns, further reducing the extent of bulge of the sidewalls should they buckle under pressure from the contents of the bin.

The invention is applicable to octagonal bulk bins regardless of the type of bottom flap construction used, but in a specific example of the invention, opposed pairs of major and minor bottom flaps are foldably joined along scorelines at one edge to respective pairs of opposed side and end walls, and have opposite free edges. The locking bottom flap construction includes cut-outs in the major flaps, and tabs on the free edge of each of the minor flaps. When the flaps are folded inwardly toward one another to close the bottom of the box, the tabs engage in the openings in the major flaps to lock the flaps in their inwardly folded position. It should be understood that this bottom flap construction does not form a part of the present invention, and other bottom closure designs can be used.

The bulk bin of the invention also may incorporate reinforcing straps in its sidewalls. In one specific example of the invention, these straps are tapes incorporated into the corrugated material. They may be spaced more closely together toward the bottom of the bin, or spaced uniformly along its height.

Although the preferred embodiment is an octagonal or eight-sided box, it should be understood that the invention may be adapted to other polygonal shapes, such as a ten-sided box, for example. Additionally, all the sides could be made equal in width, or the widths of some sides could vary plus or minus five percent from the width of other sides. Further, the box of the invention may comprise any suitable flute construction, including AA, CA, BC, etc., depending upon the desired properties. Moreover, a moisture resistant adhesive may be used in the manufacture of the box, which may additionally be treated with a suitable commercially available moisture resistant material.

BRIEF DESCRIPTION OF THE DRAWINGS

The foregoing as well as other objects and advantages of the invention will become apparent from the following detailed description when considered in conjunction with the accompanying drawings, wherein like reference characters designate like parts throughout the several views, and wherein:

FIG. 6 is a plan view of the blank glued up and folded flat for storage and shipment;

DETAILED DESCRIPTION OF THE PREFERRED EMBODIMENT

Figure 1:
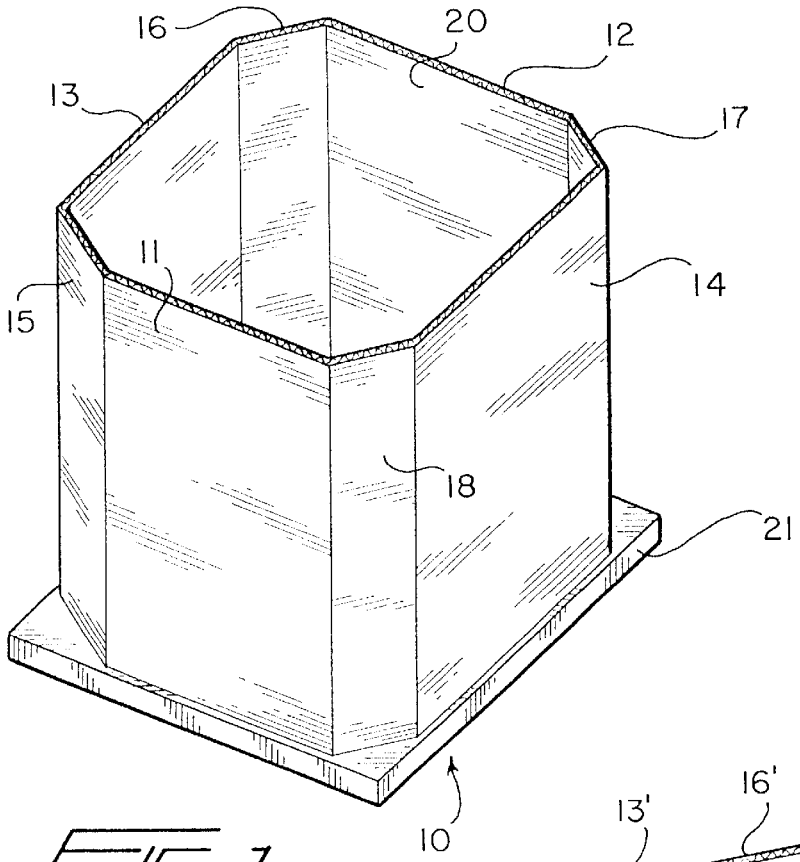
FIG. 1 (PRIOR ART)
FIG. 1 is a top perspective view of a conventional octagonal bulk bin, shown on a pallet, and without any cover or liner bag.
Figure 2:
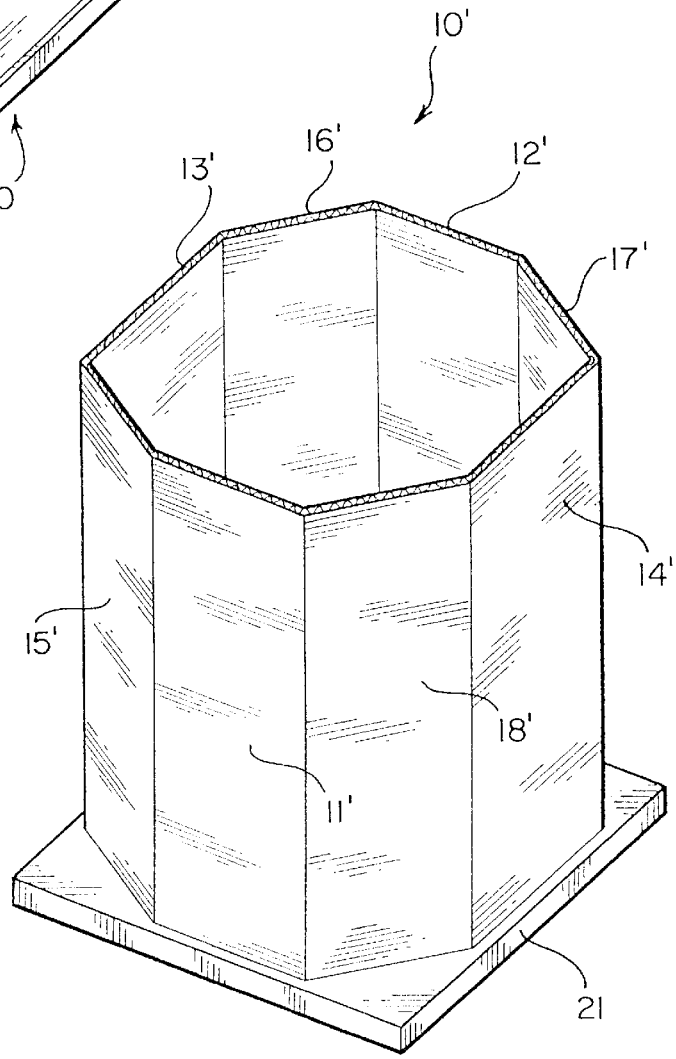
FIG. 2 is a top perspective view of the bulk bin of the invention.
Figure 4:
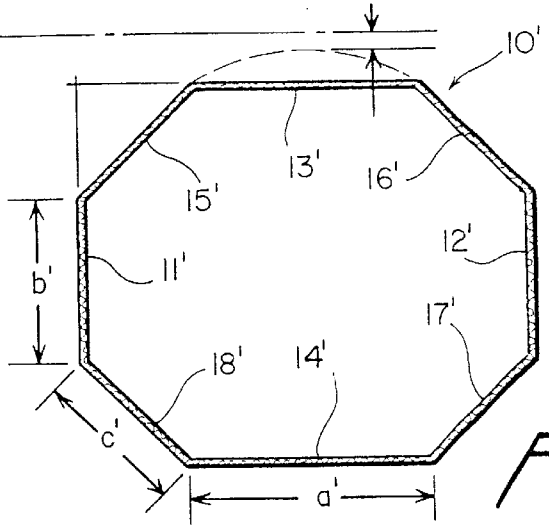
FIG. 4 is a schematic top plan view of the bin of the invention, showing the substantially equal width of the end walls and diagonal corner panels and the reduced width of the side walls, and depicting in exaggerated scale in broken lines the smaller extent of bulge of the side walls that may occur in the invention.
Figure 3:
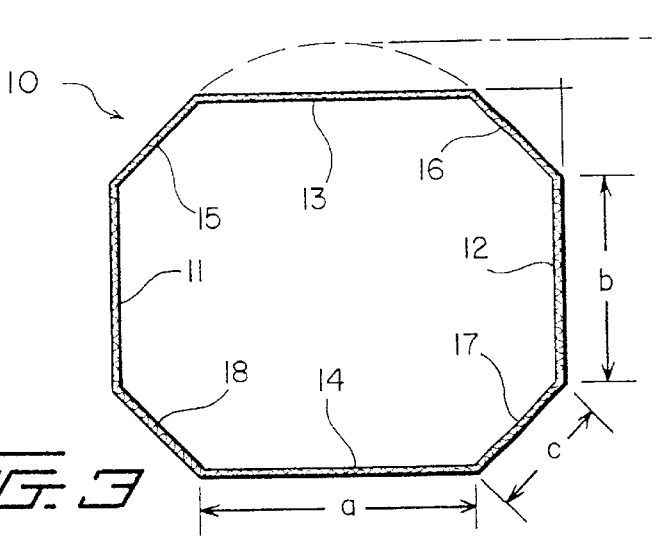
FIG. 3 is a schematic top plan view of a conventional bulk bin, showing the relatively wide side and end walls and narrow diagonal corner panels.
Figure 10:
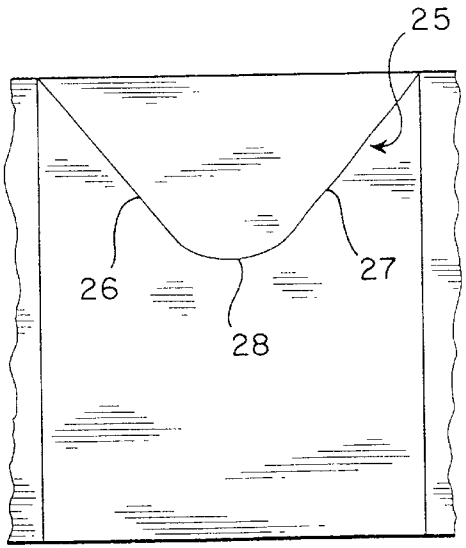
FIG. 10 is an enlarged fragmentary view in elevation of a side wall of that form of the invention shown in FIG. 7.

Referring more specifically to the drawings, a conventional bulk bin of octagonal configuration is indicated generally at 10 in FIGS. 1 and 3. This bin has two opposed end walls 11 and 12, and two opposed side walls 13 and 14, joined by diagonal corner panels 15, 16, 17 and 18. The bin is shown with an open top 20, and resting on a pallet 21. The side walls have a width "a", the end walls have a width "b", and the diagonal corner panels have a width "c". In a typical construction, the dimension "a" is 28⅜ inches, the dimension "b" is 20⅜ inches, and the dimension "c" is 12¼ inches.

In the bin of the invention, indicated generally at 10' in FIGS. 2, 4, 5 and 6, the width "c'" of the diagonal panels 15', 16', 17' and 18' is increased, and the widths "a'" and "b'" of the side and end walls 13', 14'and 11', 12', respectively, is decreased relative to their size in a conventional bin, with the same spacing between opposed side and end walls. In this regard, the dimension "c'" is increased approximately 25% and the dimension "b'" is decreased approximately 25%, while the dimension "a'" is decreased approximately 20%. This results in a slightly elongated generally equilateral octagonal bin which has six sides of equal width and two sides that are approximately 50% wider than the other sides, and in which the spacing between the side walls and the spacing between the end walls remains the same as in a conventional bin, whereby the bin of the invention fits on a conventional 48×40 inch pallet.

The dimensional relationship of the diagonal corner panels and the side and end walls in the bin of the invention reduces the perimeter of the bin while maintaining the predetermining spacing between the opposed side walls and the opposed end walls, and reduces package bulge and overhang, thus eliminating interference and fit problems on warehouse racks and in transportation trailers.

Figure 7:
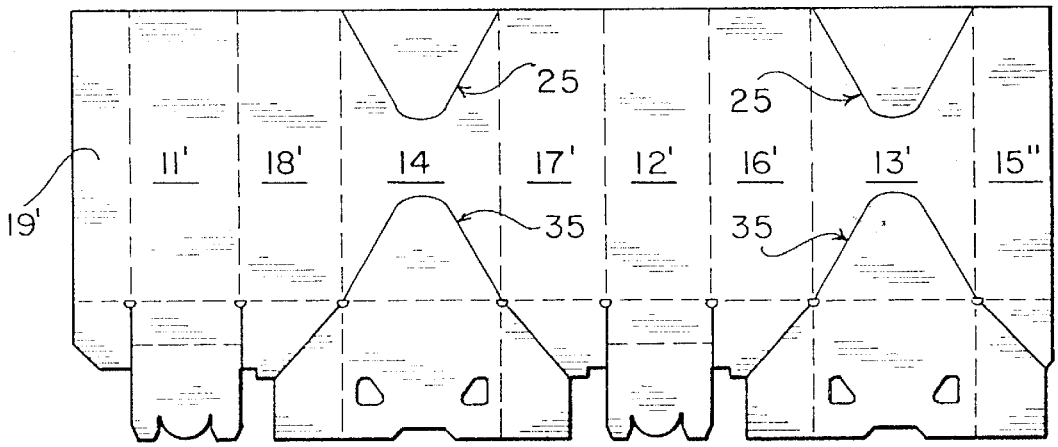
Figure 8:
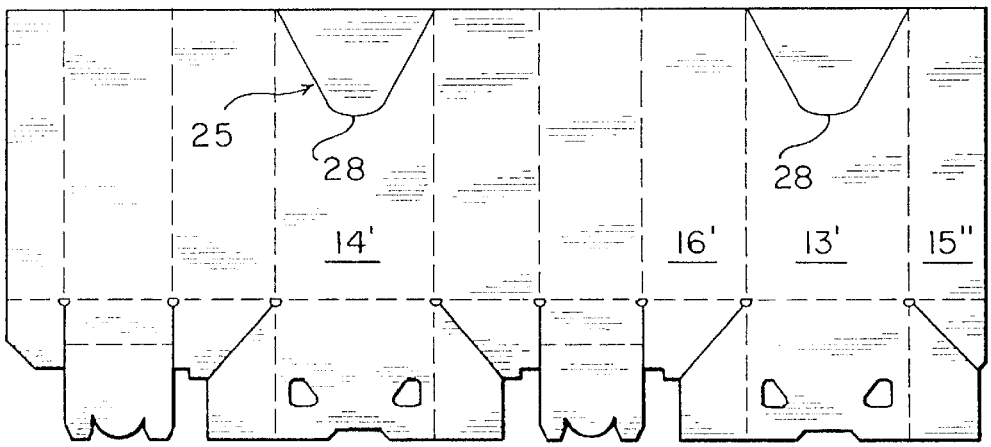

A folded and glued blank is shown at 10' in FIG. 6, in flattened condition for storage and shipment. To glue the blank, a glue tab or flap 19 or 19' may be provided at one end (see FIGS. 5 and 7), or a panel may be cut in half and slightly elongated to overlap, as shown in FIGS. 6 and 7. The blank is folded upon itself and the glue tab adhesively secured to a panel at the other end of the blank. The bin is typically manufactured and shipped in the condition shown in FIG. 6, and erected by the end user. To erect the bin, it is simply opened up or expanded into a tubular configuration and the bottom flaps moved into interlocking relationship. It may then be placed on a pallet, a bag inserted into the bin, and product loaded into the bag. A cover (not shown) may be placed on the bin.

To control buckling of the side walls, and to further minimize bulging, scores may be placed in the side walls at predetermined locations to cause predictable and controlled buckling at certain locations, thereby preventing buckling in the middle of a panel. By strategically placing the scores, buckling, if it occurs, will be distributed in spaced locations toward the sides of the panel and protrusion or bulge of the panel will be minimized.

Figure 5:
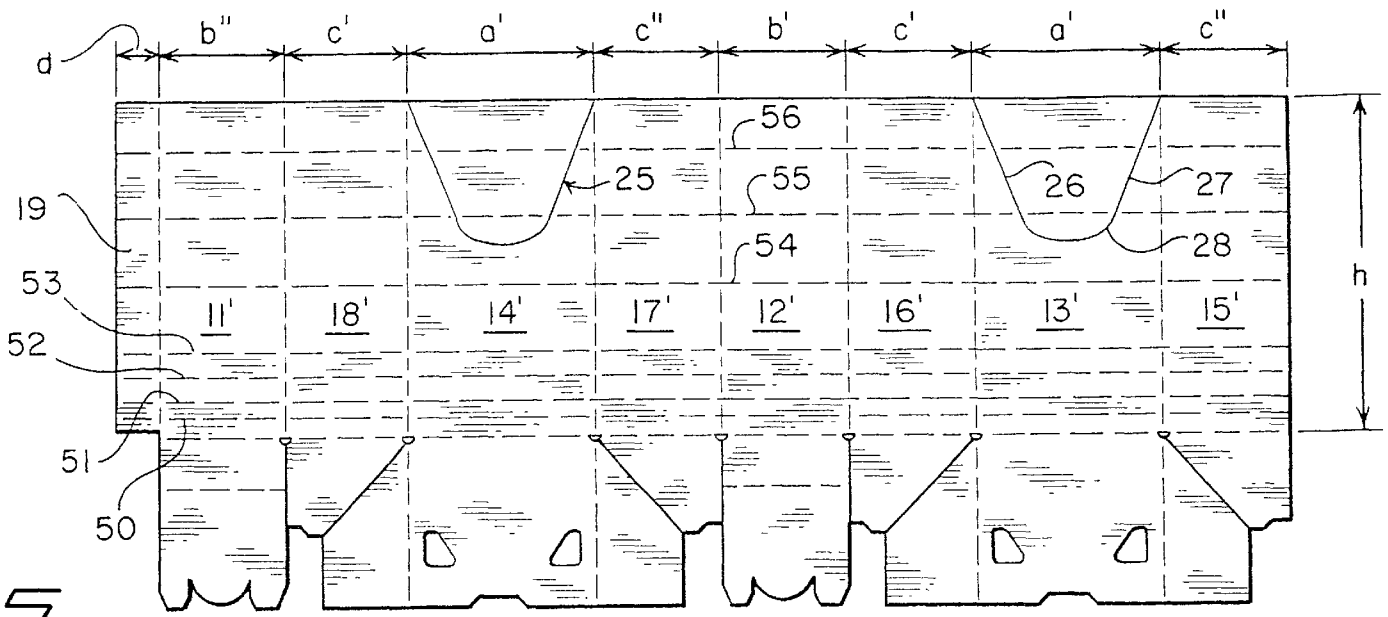
FIG. 5 is a plan view of the blank used in forming the bulk bin of FIG. 2, showing reinforcing straps and strategically placed scores to control buckling of the side walls.
Figure 8:
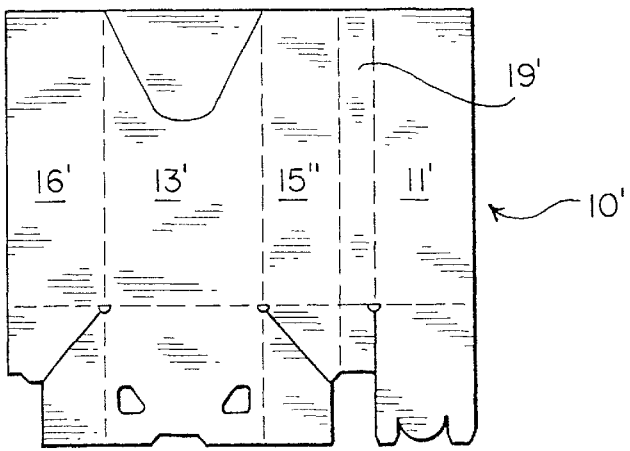
FIGS. 7–9 are plan views of blanks used to form the bin of the invention, showing different score patterns that may be placed in the side walls to control buckling and reduce bulge.

A first embodiment of a buckle-controlling score is indicated generally at 25 in FIGS. 5, 6 and 8. In this embodiment, the score has a generally parabolic shape, comprising two inwardly converging diagonal scorelines 26 and 27 extending downwardly from opposite upper corners of a sidewall panel, and connected at their lower ends by a curved scoreline 28 spaced slightly above the midpoint of the panel.

Figure 11:
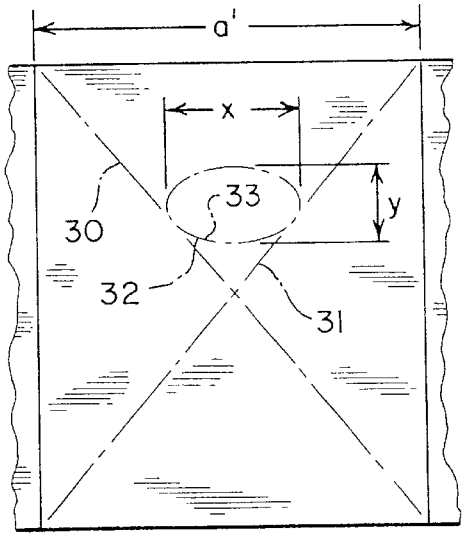
FIG. 11 is an enlarged fragmentary plan view of a side wall, showing how one of the scoreline patterns is constructed, using an elliptical shape and diagonal lines.

The size and angular relationships of the scorelines are determined as shown in FIG. 11. Thus, in constructing the score 25, a pair of imaginary diagonal lines 30 and 31 are drawn between opposite corners of a panel, and an ellipse 32 having a length dimension "x" that is one-third the width of the panel and a height dimension "y" that is one-sixth the width of the panel is positioned to touch the diagonals. The lower side 33 of the ellipse forms a bight that joins the two diagonals, and the cardboard is scored along these lines to form the score as shown, for example, in FIGS. 5–8 and 10.

In the modification of FIG. 7, scores 25 and 35 are placed at both the top and bottom of the panel.

Figure 9:
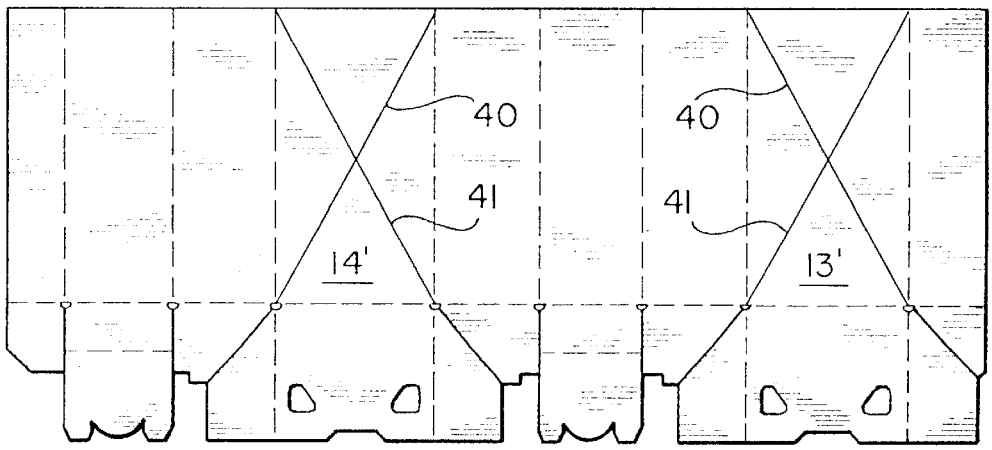

In the modification of FIG. 9, a pair of diagonal scores 40 and 41 are formed in the panel, extending between opposite corners of the panel and crossing at the middle.

The scores define weakened lines along which the panel buckles, if buckling occurs. This provides controlled and predictable buckling of the panel, with the buckling occurring near an edge rather than in the middle of the panel, and also generally horizontally rather than vertically. Buckling of a panel incorporating a score or scores in accordance with the invention results in less outward bulge than might occur with a conventional construction.

As shown in FIG. 5, reinforcing straps or tapes 50–56 may be incorporated in the corrugated material to strengthen the bin against radial expansion due to the pressure exerted on the side walls by product stored in the bin. In the particular example shown, for a bin having a height h of 40½ inches, the first tape 50 is spaced two inches from the bottom edge of the wall panels, second tape 51 is spaced two inches from tape 50, third tape 52 is spaced three inches from tape 51, fourth tape 53 is spaced three inches from tape 52, and the remaining tapes 54, 55 and 56 are spaced eight inches apart, with tape 54 spaced eight inches from the next adjacent tape 53. A greater or lesser number of tapes may be used, depending upon the requirements, and the tapes may be spaced differently, or eliminated entirely. Further, the tapes may be applied externally of the bin, if desired.

While the bulk bin of the invention has been illustrated and described herein as octagonal in shape, it could have more than eight sides, all sides could be equal in width, or the sides could vary in width by about five percent.

A loaded bulk bin according to the invention bulges significantly less than conventional bulk bins, and it appears that product stress on the package is distributed more evenly than in conventional packages, which reduces or eliminates instances of package failure.

While particular embodiments of the invention have been illustrated and described in detail herein, it should be understood that various changes and modifications may be made to the invention without departing from the spirit and intent of the invention as defined by the scope of the appended claims.

What is claimed is:

1. An octagonal bulk bin formed of corrugated paperboard and having opposed parallel side walls spaced a predetermined distance apart, opposed parallel end walls spaced a predetermined distance apart, and diagonal corner panels joining the side and end walls, wherein:

said diagonal corner panels have the same width as said end walls, the side and end walls are the reduced width at said predetermined distances apart compared to a conventional bin in which the diagonal corner panels arc of less width, and said side walls have a width approximately fifty percent greater than the width of the end walls and the diagonal corner panels, resulting in an octagon that is equilateral except that it is elongated approximately twenty percent in a direction parallel to the side walls, whereby said bin fits a predetermined standard pallet size and said side and end walls undergo minimum bulge when a flowable product is loaded into the bin, and a scoreline is formed in at least one of said side and end walls to form a line along which said wall will buckle in a controlled and predetermined manner, if it buckles, from the pressure of material placed in the bin, said scoreline having a generally parabolic shape converging downwardly from opposite upper corners of said wall and terminating in a curved bight spaced above the midpoint of the wall.

2. A bulk bin as claimed in claim 1, wherein:

a further scoreline forms a second generally parabolic shape converging upwardly from opposite lower corners of said wall and terminating in a curved bight spaced below the midpoint of the wall.

3. A bulk bin as claimed in claim 1, wherein:

at least one reinforcing strap extends around said bin to reinforce it against radial expansion.

4. A bulk bin having side walls, wherein:

a weakened area is formed in at least one of said side walls to form a line along which said at least one side wall will buckle in a controlled and predetermined manner, if it buckles, from the pressure of material placed in the bin, said weakened area having a generally parabolic shape converging downwardly from opposite upper corners of said at least one side wall and terminating in a curved bight portion.

5. A bulk bin as claimed in claim 4, wherein:

said weakened area comprises a scoreline, and said bight portion is spaced above a midpoint of said at least one side wall; and a further scoreline forms a second generally parabolic shape converging upwardly from opposite lower corners of said at least one side wall and terminating in a curved bight portion spaced below the midpoint of said at least one side wall.

6. A bulk bin as claimed in claim 4, wherein:

said side wall include a pair of opposed parallel side walls, opposed parallel end walls and diagonal corner panels joining adjacent side and end walls, said opposed side walls and opposed end walls being spaced predetermined distances apart.

7. A bulk bin as claimed in claim 6, wherein:

the diagonal corner panels have the same width as the end walls, and said end walls and diagonal corner panels have a width that is approximately two thirds the width of the side walls, defining an octagonal bin having length and width dimensions to fit on a predetermined pallet size, and said side and end walls undergo minimum bulge when a flowable product is loaded into the bin.

8. A bulk bin as claimed in claim 7, wherein:

the bin is formed of corrugated paperboard.

9. A bulk bin as claimed in claim 4, wherein:

the weakened area comprises a scoreline.

* * * * *